US005111893A

United States Patent [19]

Kvello-Aune

[11] Patent Number: 5,111,893

[45] Date of Patent: May 12, 1992

[54] DEVICE FOR DRILLING IN AND/OR LINING HOLES IN EARTH

[76] Inventor: Alf G. Kvello-Aune, N-6598 Foldefjorden, Norway

[21] Appl. No.: 632,979

[22] Filed: Dec. 24, 1990

[51] Int. Cl.[5] ..... E21B 10/66

[52] U.S. Cl. ..... 175/258; 175/269; 175/291; 175/384

[58] Field of Search ..... 175/171, 258, 269, 267, 175/273, 279, 286, 289, 291, 384

[56] References Cited

U.S. PATENT DOCUMENTS

| | | | |
|---|---|---|---|
| 2,719,701 | 10/1955 | Kammerer, Jr. | 175/291 |
| 3,169,592 | 2/1965 | Kammerer | 175/257 |
| 4,470,470 | 9/1984 | Takano | 175/260 |
| 4,544,041 | 10/1985 | Rinaldi | 175/171 X |

*Primary Examiner*—Terry Lee Melius

*Attorney, Agent, or Firm*—James E. Pittenger

[57] ABSTRACT

A device for drilling and lining holes in earth bores wherein a casing is intended to be lowered into the bore along with the drilling unit. The drilling unit is mounted on a rotating drill. The drilling unit includes a plurality of cutters which can be arranged in the extended active position or can be retracted to a passive position arranged within the casing of the drilling unit. Drilling fluid through an activating piston repositions the cutters between the passive and the active position. The drilling unit includes a gripping device which contacts a groove in the casing which carries the casing down the bore with the drilling unit. Threaded ribs within the drilling unit act as a pump to maintain down hole drilling fluid pressure. A valve is provided in conjunction with the cutters whereby when the cutters are moved to the active position the valve will open allowing flow of the drilling fluid.

15 Claims, 2 Drawing Sheets

DEVICE FOR DRILLING IN AND/OR LINING HOLES IN EARTH

FIELD OF THE INVENTION

The invention concerns a device for drilling and/or continual lining of various masses such as earth, crushing zones or rock. This type of equipment is also known as reaming equipment.

BACKGROUND OF THE INVENTION

During geological investigations, oil drilling etc., there is a need to line holes in formations with casing, sometimes this is necessary during sampling operations. Whenever holes are drilled in earth, loose sediments or rock, there is a danger that the hole may cave in. This can be prevented by the use of casing.

Existing equipment for such drilling consists of rotating casing. This necessitates that both the drive unit and the casing are constructed to withstand considerable resistance downhole and increasing resistance the greater the depth. Thus, the hole is restricted in total depth and the equipment is expensive. Another problem is that there can be extensive damage if the casing is ruptured by the sediments and torn off. In addition, existing methods are not easy to work with.

OBJECTIVES

The main objective of the invention is to devise equipment for drilling and lining holes where the above disadvantages are reduced. One particular objective is to invent a device where the casing can be lowered downhole without rotation so as to reduce the wear on the pipe and achieve a considerable reduction in the power requirements. A further objective is to use the equipment together with different types of bottom assembly units such as full drilling equipment, core samplers, logging equipment and such like.

SUMMARY OF THE INVENTION

The basic principle of the invention is stated in the characterizing part of claim 1 of patent.

Other advantageous features of the invention are stated in the subsidiary claims.

The main advantage of the invention is that drilling or underreaming is combined with axial lowering of the casing. This leads to a substantial reduction in the drive power required.

Another advantage with a device in accordance with the invention is that if the device is brought to a halt because of rock or other blockages that lock the casing, drilling can be continued with smaller diameter equipment, this is known as telescopic drilling.

The invention also enables existing holes to be widened, such as in connection with a downhole well.

The invention makes the retraction of the drilling equipment easy for inspection, sampling, changing the bit/cutting equipment, whilst the casing prevents the hole from caving in.

The underreamer can also be used for pipe cutting downhole or for scraping (cleaning) of the hole/-pipewall that has been coated by mud.

EXAMPLE

Figure 1:
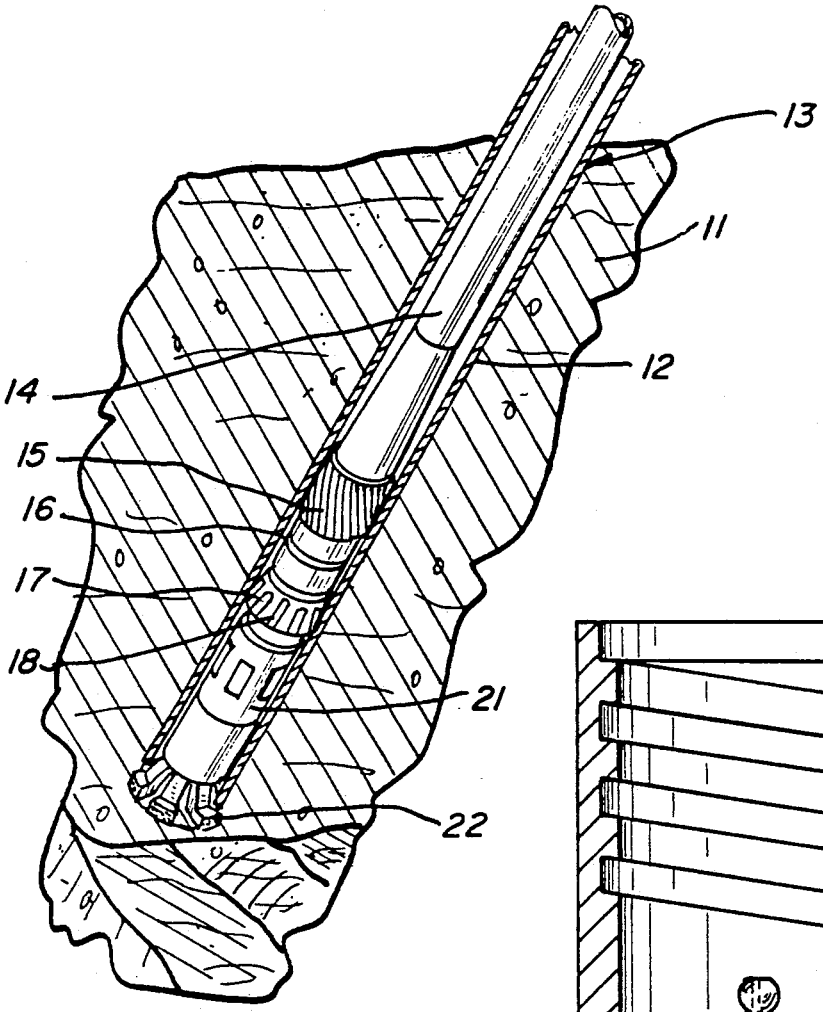
Figure 3:
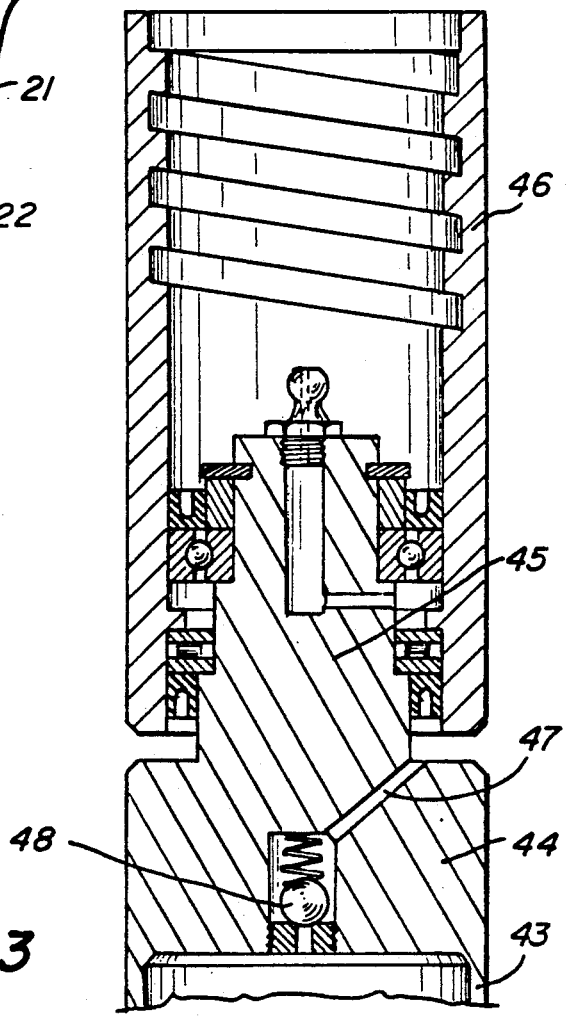
Figure 2A:
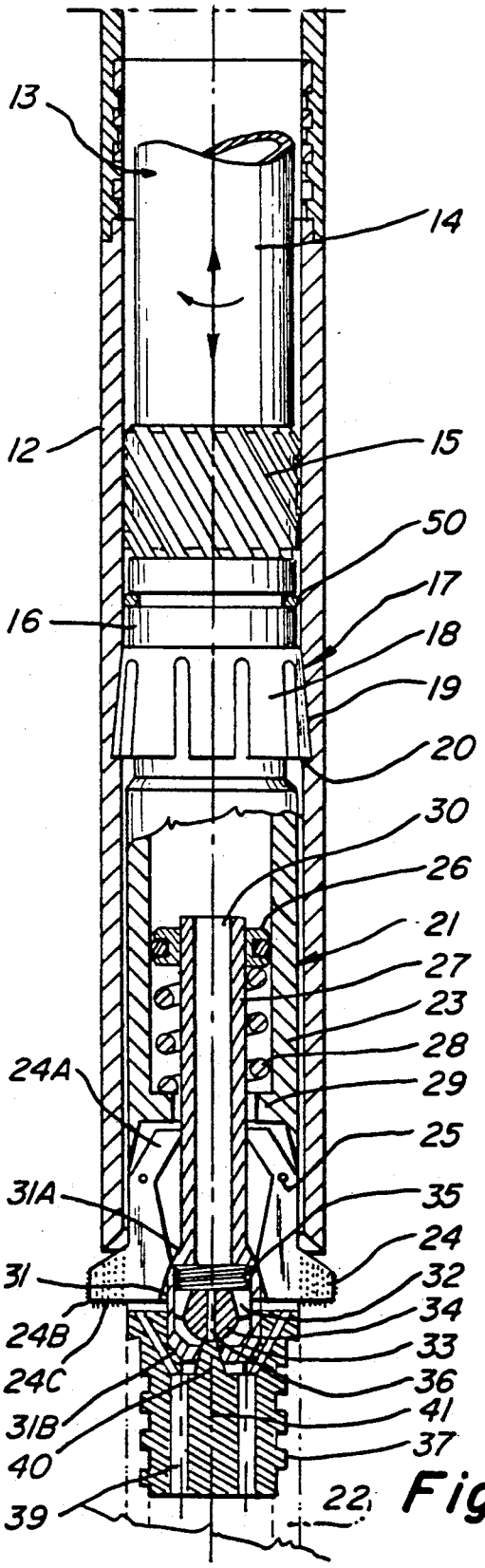
Figure 2B:
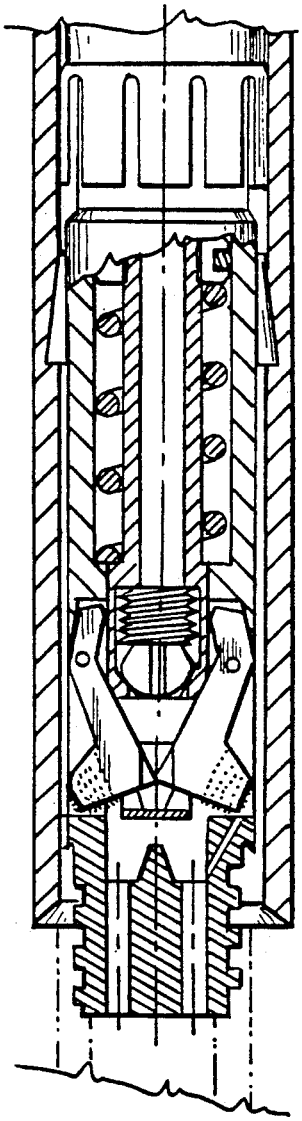

The invention will be described in more detail by reference to the illustrations, where:

FIG. 1 shows a schematic vertical section of a device in accordance with the invention during drilling in a sedimentary layer containing stone, FIG. 2A–B shows an axial section through a design of the invention with casing and reamer arms in two different positions, whilst FIG. 3 shows a vertical section through the bottom end assembly with a form of design intended for sampling through the lowering of a pipe.

FIG. 1 shows a drilling situation in a layer 11, exemplified by a mixture of rock and stone, where a device in accordance with the invention is in operation. A rotating string 13 is attached to the casing 12, which is being forced downwards by a non-illustrated gripping mechanism of known principle. The string 13 is connected at its upper end to a drilling device with a hydraulic motor (not-illustrated) or another suitable drive unit.

The upper end of the string 13 consists of a drill pipe 14 which on its lower end has a circular ring or retaining ring 15 of screw-shaped ribs which form a pumping organ for pumping water down into the casing 12, thus preventing water from rising from the area which is being drilled.

Beneath the ring 15 there is an O-ring 50 which prevents the flushing water from rising. If necessary, some flushing fluid can be allowed through to flush and clean the area between the underreamer (see below) and the casing. It is also possible to exchange the positions of the ring 15 and the sealing ring 50.

Beneath the pumping ring 15 the drill pipe 14 terminates with a thrust bearing 16 if there is a gripping ring 17 at the lower end. The gripping ring 17 has a set of downward and outward-protruding spring tongues 18 (FIG. 2). These tongues 18 are designed to engage in an internal circular groove 19 in the casing. The groove 19 diverges towards a stop 20. The spring tongues 18 are elastically tensed outwards in the position shown in FIGS. 2 and 3B so that as the drill pipe is lowered in the casing 12 they glide in the groove 19 and are firmly in contact with the stop 20 thus drawing the casing downwards when the drill string is forced down by the non-illustrated gripping mechanism.

In the same way the gripping ring 17 can be retracted from the casing 12 in order to extract the casing ??? for maintenance or the like.

Under the gripping ring 17 the bearing 16 supports an under-drilling unit or underreamer 21 that will be described in more detail in the explanation of FIG. 2. This unit supports a bit 22 at the end.

Water under pressure flows through the internal part of the drill string 14 to activate the operative parts of the underreamer 21 and also secure the flow of water to the drilling area.

FIG. 2 shows a more detailed design of an underreamer 21 which can be used with the device in FIG. 1. This consists of a cylinder 23 which extends axially downwards from the gripper ring 17 and which has a set of reamer arms 24, the illustration shows six, these are angle levers which can rotate in a radial plane on pivots 25 mounted on the cylinder 23.

Above the reamer arms 24 the cylinder is equipped with a piston 26 in an internal chamber. The piston 26 is screwed to the upper end of an activating rod 27 that extends down to the reamer arms 24. When at rest the activating rod 27 presses against a helical spring 28 between the piston and a ring wall 29 that protrudes in and above the reamer arms 24.

The activating rod 27, which has a central channel 30, is wider at its lower end so that an activating ring 31 is formed with upper and lower sloping edges, 31A and 31B respectively. The extension also forms a valve chamber 32 with a downward facing valve seat 33, a generally spherical valve unit 34 with a flattened top and an upper cup spring 35. The valve unit 34 has a channel 36 through it.

The reamer arms 24 are shaped like levers with an upper part 24A which is directed radially inwards and upwards so that the end is controlled by the upper edge 31A of the activating ring 31 and is pressed outwards when the activating rod 27 is in its upper end position or rest position. The other, lower part of the arm 24B, which in this case is about three times as long as the upper arm, ends in a radial upward cutter with a cutting edge pointing downwards 24C. This part is pressed outside the activating ring 31 when the activating rod 27 is downwards in the lower end position as shown in FIG. 2A. The passive, withdrawn position of the reamer arms is shown in FIG. 2B.

The underreamer unit 21 extends downwards beneath the reamer arms 24 and here there is an external thread 37 which the sleeve-shaped bit 22 is screwed onto. Through the lower part of this there are two or more axial channels 39 which are connected from the valve seat 33 down to the drilling area. There is an upward conical lug 40, which is central at the end of the space for the activating rod 27, as at the end position of the activating rod shown in FIG. 2. This lug forces the valve unit 34 out of the valve seat 33. The lug 40 has a channel 41 through it to the drilling area, which is connected to channel 36 by means of valve unit 34.

From each of the longitudinal channels through the lower part of the drilling unit 21 there is a channel which leads upwards and out towards the edge near the cutters 24C, so that fluid is supplied to this area.

During drilling a fluid to contain the pressure is supplied through the interior of the drill string 14. This will activate the drilling unit 21 so that the cutters 24B swing out in an active position. At the same time fluid will be supplied to the drilling area through channels 39, 41 and 42.

When the pressure is reduced the activating rod 27 will be forced upwards by the pressure from the spring 28 and this will swing the reamer arms 24 over into the withdrawn, passive position.

If the flushing fluid pressure is under a certain level (in sum lower than the tension of the spring 28) the underreamer can drill internally in the drill pipe in order to clean or cut pipe. The flushing pressure determines the radial power on the arms for radial cutting (pipe cutting or starting reaming in other masses).

In FIG. 3 there is another means of design where the bit in the example is replaced by a pipe 43 with a closed upper end 44, this is the type used for sampling. The pipe 43 is equipped with an axial lug 45 protruding above the upper end which is fitted to a sleeve 46 with an internal thread which can be screwed into the lower end of the drilling unit 21 (FIG. 2). Air or fluid can be extracted from the inside of the sampling pipe 43 through an outlet vent 47 with a unidirectional valve 48 on the upper end 44 of the sampling pipe 43.

A device in accordance with the invention can be used with a stuffing box on the casing 12. Thus one zone can be isolated whilst under pressure.

The device is activated during drilling by it being rotated and fed with drill pipe 14 from a known surface drilling unit or by known subsea motors where the pressure medium is supplied through hoses from the surface.

The design of the valve and the valve control in the drilling unit 21 like the means of mounting the reaming arms can be modified in relation to that described in the example.

ALTERNATIVE DESIGNS

The framework of the invention enables various modifications to be made to the example. The three elements above the underreamer 21, i.e., the sealing ring 50, the carrier 18 and the retaining ring 15 are all positioned so as to be mutually interchangeable.

The cylinder 23 can be equipped so that drilling can be done in the wall out from the cylinder, so as to force drilling fluid outwards to clean the annulus facing the casing.

The reamer arms 24 can be internally pivoted from the lug on the lower part of the cylinder 23 beneath the ring wall 29.

The device can also rotate whilst being lowered inside existing casing. This may be necessary to cut casing or scrape it clean of deposits or other contamination.

What is claimed is:

1. A device for drilling holes in earth, rock or similar bodies, comprising a casing which is designed to be lowered together with a drilling unit, wherein the drilling unit is mounted on a rotating drilling string which is centrally positioned within the casing and the drilling string being provided with a first abutment which on downward movement of the drilling string is pressed against a second abutment within the casing to press the casing downward, said drilling string being provided with a plurality of cutters which can either be pivoted between an active and a passive position by activating means, said activating means comprising a hollow activating member which is operated by drilling fluid passing through the drilling string, characterized in that the activating member further includes an annular piston which is received within a cylinder arranged at the lower end of the drilling string, said annular piston connected to a concave rod and an activating cam having a passage way communicating with a valve for controlling the drilling fluid supplied to the cutters, and the lower end of the activating member is arranged to operatively engage the drilling cutters to move them to and from the active and passive positions and said valve being arranged to open when the cutters are moved to the active position.

2. A device in accordance with claim 1, characterized by said first abutment comprising an annular array of spring tongues which are pivoted on the drilling string and which extend downwards and outwards and are biased so as to engage the casing, and wherein the casing is equipped with an equivalent internal gripping groove providing the second abutment.

3. A device in accordance with claim 1, characterized by the drilling string being equipped with a retaining ring with helical ribs which act as a pump for pumping drilling fluid within the device and a sealing ring arranged adjacent to said retaining ring.

4. A device in accordance with claim 1, characterized by the cutters being arranged on a plurality of levers which are pivoted in an annular arrangement around the activating means.

5. A device in accordance with claim 1, characterized by the piston being connected with said activating cam which operates the levers through the activating member.

6. A device in accordance with claim 5, characterized by the activating member being equipped with a channel for allowing passage of the drilling fluid controlled by said valve.

7. A device in accordance with claim 1, characterized by the cutters being designed to cut the casing.

8. A device for drilling and lining holes in earth, rock or the like, having a casing which is designed to be lowered together with a drilling unit, and where the drilling unit is mounted on a rotating drill pipe which is centrally positioned in the casing and is equipped with a plurality of cutters which can be moved between an active and a passive position, and the drilling unit is equipped with a hydraulically operated activating member, characterized in that the drilling unit is provided with a hydraulic piston means connected to an axially extending activating rod which includes a means to move the cutters between their active and passive positions, and the drilling unit is equipped with a gripping means having an annular series of spring tongues which are carried by the drilling unit and extend downwards and are biased outwards, and the casing includes a mating internal gripping groove whereby downward motion of the drilling unit causes the gripping means to make firm contact with the casing groove so that the casing is forced downward within the hole.

9. A device in accordance with claim 8 characterized by the drilling unit being equipped with a retaining ring having helical ribs which act as a barrier against infiltration of drilling fluid.

10. A device in accordance with claim 8 characterized by the drill pipe being equipped with a retaining means, said retaining means including one or more seal rings to act as a barrier against infiltration of drilling fluid.

11. A device in accordance with claim 8, characterized by the piston means including a cylinder which is centrally located within the drilling unit and connected to a rod including an activating cam, said rod and cam being arranged to move the cutters from the retracted passive position to the active extended position.

12. A device in accordance with claim 11, characterized by the activating cam being shaped as a ring.

13. A device in a accordance with claim 11, characterized by the connecting rod having an internal axial channel to allow the passage of drilling fluid and a control valve located at the end of the connecting rod whereby the valve will open when the cutters are moved to the active position so that the drilling fluid will flow through the connecting rod.

14. A device in accordance with claim 1, whereby the cutters include means to cut the casing.

15. A device in accordance with claim 1, characterized by the cutters including means to scrape the internal surface of the casing.

* * * * *

UNITED STATES PATENT AND TRADEMARK OFFICE

CERTIFICATE OF CORRECTION

PATENT NO. : 5,111,893

DATED : May 12, 1992

INVENTOR(S) : Alf Gunnar Kvello-Aune

It is certified that error appears in the above-identified patent and that said Letters Patent is hereby corrected as shown below:

ON THE TITLE PAGE:

| | | |
|---|---|---|
| [22] | PCT Filed: | June 27, 1989 |
| [86] | PCT No.: | PCT/NO89/00065 |
| | § 371 Date: | Dec. 27, 1990 |
| | § 102(e) Date: | Dec. 27, 1990 |
| [87] | PCT Pub. No.: | WO90/00216 |
| | PCT Pub. Date: | Jan. 11, 1990 |

[30] Foreign Application Priority Data

June 27, 1988 [NO] Norway ..... 882830

Signed and Sealed this

Twentieth Day of July, 1993

*Attest:*

*Attesting Officer*

Michael K. Kirk

MICHAEL K. KIRK

*Acting Commissioner of Patents and Trademarks*